United States Patent [19]

Eriksson et al.

[11] Patent Number: 4,848,681

[45] Date of Patent: Jul. 18, 1989

[54] WEAR RESISTANT ELEMENT INCLUDED IN A MILL LINING

[75] Inventors: Klas-Göran Eriksson, Kage; Rolf Stenman, Skelleftea, both of Sweden

[73] Assignee: Skega AB, Ersmark, Sweden

[21] Appl. No.: 111,424

[22] Filed: Oct. 22, 1987

[30] Foreign Application Priority Data

Jun. 2, 1987 [CA] Canada ..... 538568

[51] Int. Cl.[4] ..... B02C 13/28

[52] U.S. Cl. ..... 241/183; 428/67; 241/299; 241/300; 241/DIG. 30

[58] Field of Search ..... 428/67; 241/300, DIG. 30, 241/299, 182, 197, 183

[56] References Cited

U.S. PATENT DOCUMENTS 3,353,758 11/1967 Whaley et al. ..... 241/300
3,607,606 9/1971 Beninga ..... 428/67
4,394,982 7/1983 Wilson ..... 241/300
4,717,083 1/1988 Quast et al. ..... 241/300

FOREIGN PATENT DOCUMENTS 948439 8/1982 U.S.S.R. ..... 241/300

*Primary Examiner*—Alexander S. Thomas
*Attorney, Agent, or Firm*—Cushman, Darby & Cushman

[57] ABSTRACT

A wear resistant lining element for a rotary grinding mill. The element, which is made of elastomeric material, is provided on its leading side with respect to rotation with a hard wear layer made, for example, of steel. The hard wear layer is backed and supported by the elastomeric material of the element to which it is secured by chemical and/or mechanical bonding. With this arrangement, the elastomeric component cushions the hard wear layer and provides damping during grinding impact and minimizes cracking of the hard layer and scrap loss.

12 Claims, 4 Drawing Sheets

WEAR RESISTANT ELEMENT INCLUDED IN A MILL LINING

BACKGROUND OF THE INVENTION

This invention relates to wear resistant elements in the form of lifters of an elastomeric material, for example wear rubber, used in a lining for a mill having a rotary grinding drum, for example an autogenous mill.

Such a lining for a mill includes wear elements of steel or an elastomeric material such as wear rubber, and these wear elements have the form of wear plates and lifters, the lifters of the lining being anchored to the drum mantle and holding the wear plates located between themselves clamped to the inside of the drum mantle. Especially in mills with grinding bodies of some form, e.g. steel balls or round steel rods, the lifters of the lining are, above all, exposed to a heavy wear and great impact stresses resulting in a rapid wear of the lifters, whether they consist of hard steel or wear rubber. If rubber is subjected to a gliding wear or to a gliding wear and small impact stresses, it is far superior to steel, as well as cast iron as wear material in mill linings, but if it is subjected to gliding wear and also to great impact stresses it has in principle, the same weakness as steel and cast iron. That is, scraps are easily worn out of the material in the lifters and primarily from the parts of the lifters being furthest away from the drum mantle. This means that the higher the lifters are, the quicker they are worn from the beginning and this circumstance has so far prevented the realization of the desideratum to be able to use as high lifters as possible in mills working with grinding bodies and even without such bodies, e.g. autogenous mills. High lifters give a better economic yield than low lifters.

As to lifters of steel, they have, as distinguished from lifters of an elastomeric material, a very great tendency to break when exposed to heavy impact stresses and, the harder steel the more brittle it will be, and, at the same time, it will be more sensitive to rupture, especially if the lifter is high and is rigidly attached, by means of bolts, to drum mantle, ruptures arising, almost without exception, about the place of attachment of the lifters.

Canadian patent 852 723 discloses a lifter of steel, vulcanized to a means of attachment consisting of rubber, by which the steel lifter is attached to the drum mantle with the aid of attaching rails and bolts. A certain resilient attachment of the lifter is achieved by this arrangement and, this way, rupture about the place of attachment of the lifter at the drum mantle is avoided. However, this known type of lifter has also the previously-mentioned weakness that scraps are torn off easily in connection with great impact stresses and most rapidly at the parts of the lifter located furthest away from the drum mantle. Therefore, it is not remunerative, either, to design this type of lifter with a somewhat higher height.

SUMMARY OF THE INVENTION

It is therefore the object of the invention to provide a wear resistent element functioning as lifter in a mill lining and being so constituted that it is worn out as slowly from the beginning to the end, independently of its height.

In accordance with the present invention, this is achieved in such a way that the wear element of the elastomeric material is on its leading side, facing the direction of rotation of the drum, provided with at least one wear body of a hard material, e.g. steel, which rests against a layer of the elastomeric material in the wear element. With this arrangement, the elastomeric layer or component of the wear element cushions the hard material body or component, e.g. steel, provides damping during impact and minimizes cracking and scrap loss. This permits the use of steel harder than that previously used in homogeneous steel lifters. This provides a distinct advantage over previous lifters element made completely from elastomeric material or completely from metal.

BRIEF DESCRIPTION OF THE DRAWINGS

The invention is described in the following in greater detail with reference to the enclosed drawings, wherein.

DETAILED DESCRIPTION

Figure 3:
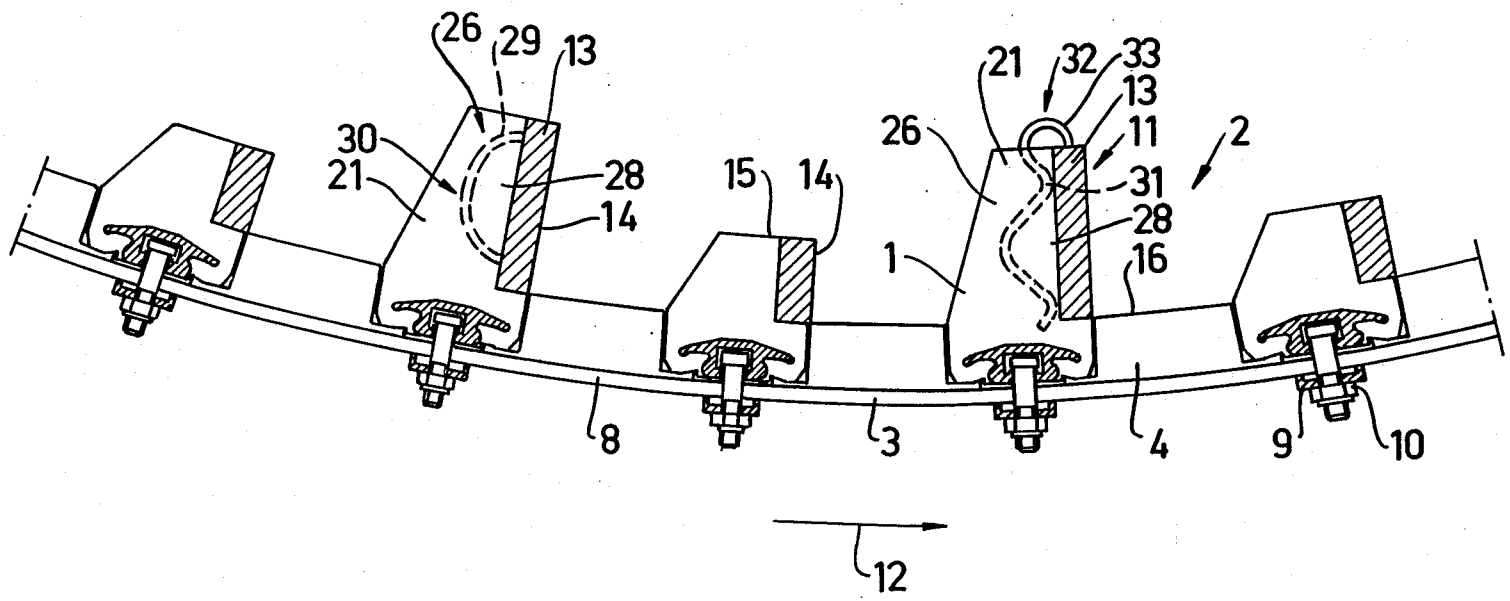
FIG. 3 shows a section of part of a drum mantle of a mill having a lining containing wear elements according to the invention.

In the drawings, 1 designates a wear-resistant element according to the invention, which is a lifter bar to be used in a lining 2 of an elastomeric material, e.g. wear rubber, for a rotary drum 3 of a mill. In addition to lifter bars, 1 the lining shown comprises wear elements in the form plates 4 having a substantially lower height than the lowermost lifter bar 1. For the attachment of the lining to the drum 3 of the mill, the lifter bar 1 is, in a known manner, provided with a rail 5 of attachment with a groove 6, mounting bolts 7 being introduced into the groove. These bolts extend through holes in the mantle 8 of the drum 3 and are, on the outside thereof, provided with a washer 9 and a nut 10, by means of which the lifter 1 is tightened against the drum mantle 8 and will clamp the adjacent wear plates 4 against the mantle 8, as shown in FIGS. 3–5.

In its longitudinal lateral portion 11, facing the direction of rotation of the drum marked by the arrow 12, the lifter 1 is provided with one or more wear bodies 13 of steel, preferably chromium-molybdenum alloyed, at least in the surface layer, the leading surface of said wear bodies 13 forming a hard wear surface 14. This surface can extend from the free end section 15 of the lifter to the level of the inside 16 of the wear plates 4 or terminate at a distance from the inside 16, as is the case at the lifter designated by 17 in FIG. 4.

Figure 1:
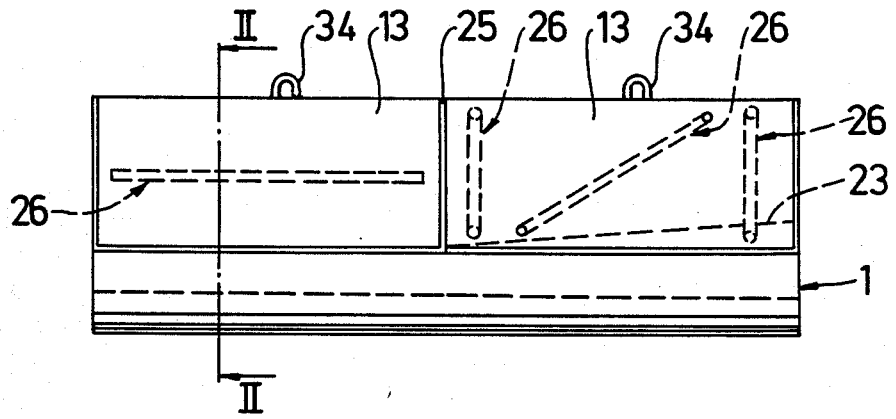
FIG. 1 is a lateral view of a lifter according to the invention, provided with two wear bodies of hard material.
Figure 4:
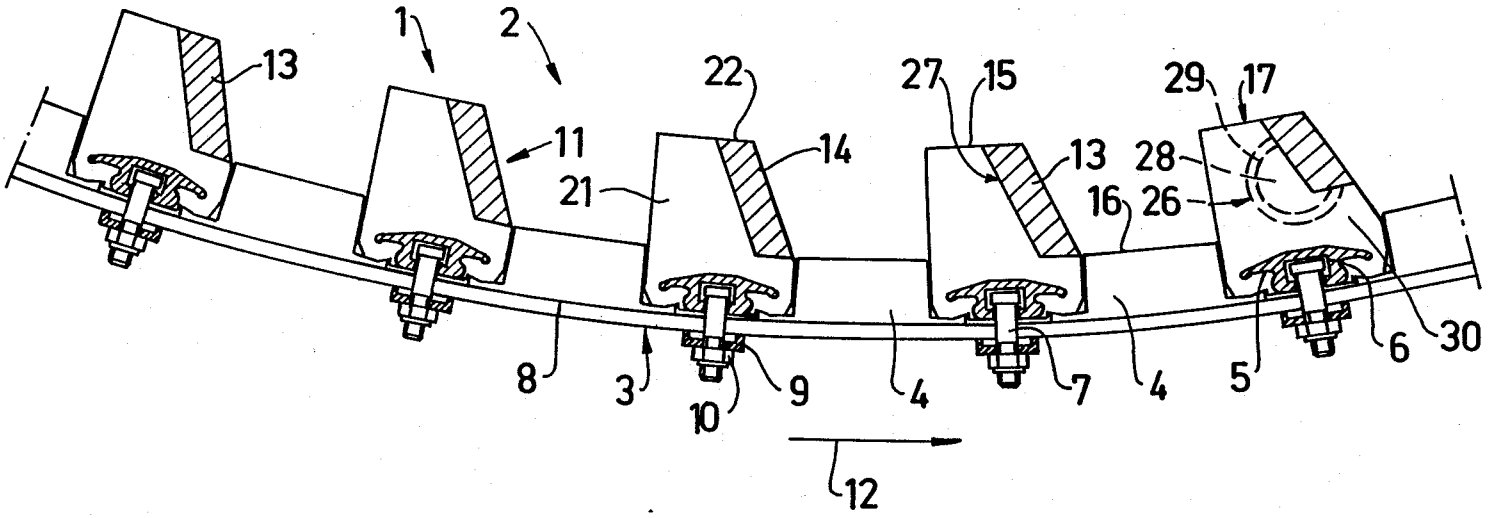
FIGS. 4 and 5 show the same as FIG. 3, but with some additional embodiments of the inventive wear element.
Figure 5:
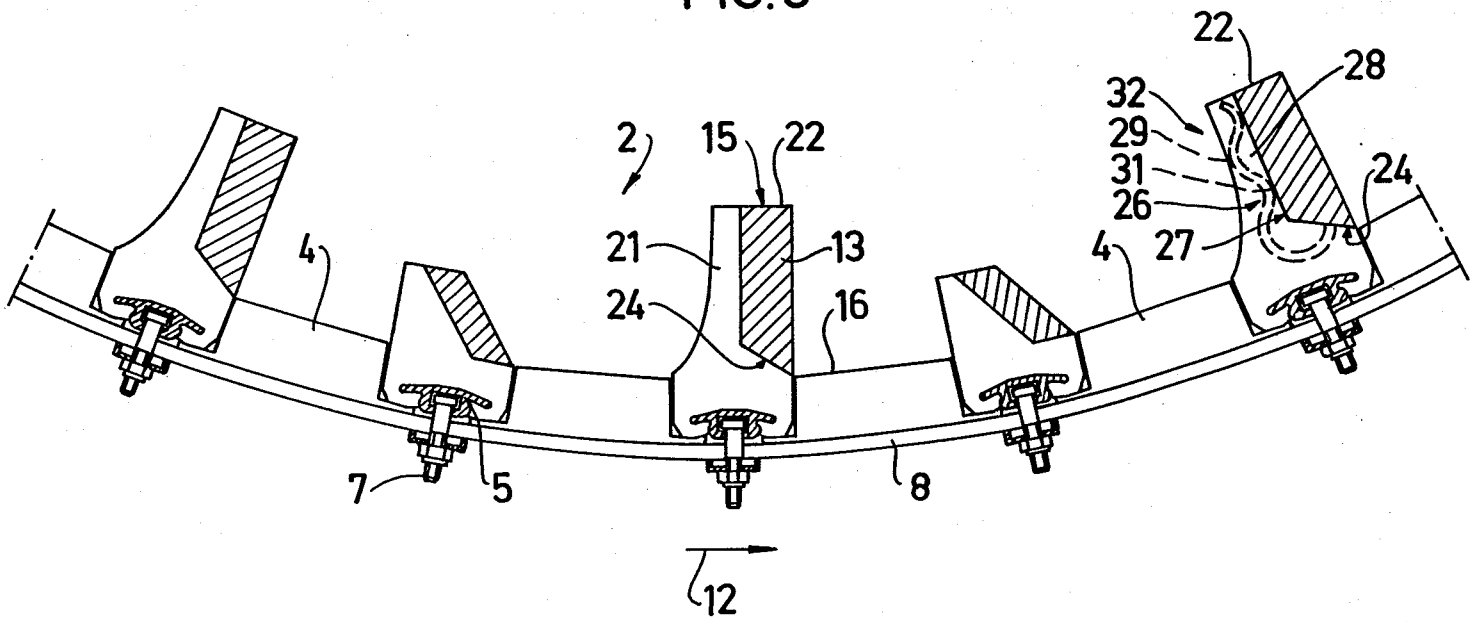

The wear surface 14 of the wear bodies can be substantially parallel to a radial plane through the associated lifter bar 1 or inclined to this radial plane, as shown in FIGS. 1 and 4. By such an inclined wear surface 14 of the lifter, a low height of fall for the grinding bodies and/or the grinding material itself used in the mill (not shown), can be achieved.

Each wear body 13 is vulcanized to the lifter bar 1, but can also be attached by means of flat washers 18 and bolts 19 introduced into holes 20 in the elastomeric layer 21 of the lifter bar located behind the wear body 13 and serving as an elastic support pad or cushion for each wear body 13. Using only the latter type of attachment, the wear bodies 13 can be replaced. It is also possible and advantageous to have the wear bodies 13 both vulcanized and screwed onto the elastic support pad 21 of the lifter bar, resulting in a chemical as well as a mechanical bonding between the two parts 13 and 21, and consequently in a very strong anchorage of each wear body 13 to the associated lifter bar.

Figure 2:
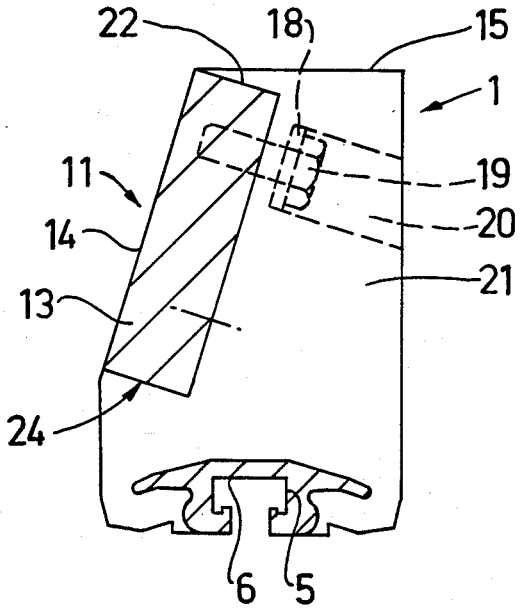
FIG. 2 shows a section taken along the line II—II in FIG. 1.

The front and rear sides of the wear bodies 13 are shown to be plane-parallel, but, if required, the wear bodies 13 can be designated with a thickness increasing from or towards the drum mantle 8. The longitudinal edge sides 22,24 of the wear bodies need not be mutually parallel, either, neither transversely nor longitudinally, the latter being indicated by a dashed line 23 in FIG. 1. The upper longitudinal edge side 22 of the wear bodies 13 should be on a level with and in line with the inwardly facing end surface 15 of the support pad 21 of the lifter bar and be completely uncovered, which is to be preferred in most cases, instead of having it embedded in the elastomeric material, as shown in FIG. 2.

The support pad 21 for the steel wear bodies 13 incorporated in a lifter bar 1, is designated with an increasing thickness towards the drum mantle 8 and the minimum and maximum width or thickness of the support pad is calculated with respect to the resilience, non-rigidity and degree of impact damping required by the used grinding bodies and/or the grinding material itself in respect of their size and weight in each specific case in order to obtain the best possible results, not the least as to endurance and life of the lifter bars that have been substantially improved through this invention. As to resilience, non-rigidity and impact, damping the hardness of the elastomeric material used in the lifter bar is also of importance. A suitable hardness of the elastomeric material is 55–75 Shore and preferably 60 Shore.

The wear bodies 13, on their part, should have a hardness at any rate in their wear surface, which is adapted to the grinding bodies and/or the grinding material itself used in the lined drum 3. It should be about 600 Brinell, and even higher in certain cases. For example, in semi-autogenous mills, the wear bodies 13 should have a hardness lying just below 600 Brinell and in autogenous mills, the hardness of the steel wear bodies 13 could be higher than 600 Brinell.

In order to eliminate arising breaking effects in the wear bodies 13, which can result in crack formations and consequently indications of fracture in the wear bodies 13, the bodies should not have a longitudinal extent longer than about 2 yards, preferably less than one yard. In FIG. 1, it is shown how two wear bodies 13 are arranged beside each other in the same lifter bar 1. The outer edge of each outermost wear body 13 of a lifter bar should terminate a short distance from the outermost end of the lifter bar, and between the facing ends of adjacent wear bodies 13 there should be an interspace 25 filled with the elastomeric material of the lifter bar.

Further, the steel wear bodies 13 could each be provided with at least one projection 26 on their rear surface 27, as shown in FIG. 1 and 3–5. Each projection extends into the elastomeric material of the support cushion 21 of the lifter bar 1 and forms at least one opening 28 to provide a mechanical bonding between the steel wear body 13 and the associated support cushion 21 of the lifter bar 1, in addition to the chemical bonding therebetween resulting from the vulcanization of the lifter bar 1 and not necessarily in addition to the mechanical bonding resulting from the bolt joint 19. The bolt joint could be omitted, if the steel wear bodies 13 are provided with such projections 26.

Preferably, the projections 26 are made of steel bars 29 formed as a curve or a bow having its ends attached, as by welding, to the back of the steel wear body 13, as shown at 30 in FIG. 3 and 4, or as a wave-line having its wave troughs 31 attached, as by welding, to the back of the steel wear body 13, as shown at 32 in FIGS. 3 and 5. FIG. 4 and 5 show, at 30 and 32, respectively, also the possibility of having one end of the steel bar projections 26 attached to the lower edge side 24 of a steel wear body 13. FIG. 3 illustrates, at 32, the possibility of having at least same of the steel bar projections 26 extending out of the end section 15 of the lifter bar 1 as a lifting lug 33 having one end attached, as by welding, to the upper edge side 22 of a steel wear body 13.

A modified lifting lug arrangement is illustrated in FIG. 1, in which the lifting lugs 34 are provided along the upper edge side 22 of the steel wear bodies 13 and have their ends welded thereto. This lifting lug arrangement 34 is designed particularly for lifters having steel wear bodies without any projections 26 or having the steel bar projections 26 of the steel wear bodies 13 extending in a parallel or an inclined relationship to the longitudinal upper end section 15 of the lifter bar. Each steel wear body 13 could be provided with more than one steel bar projection 26.

By the inventive combination of a hard wear layer or component of steel and a support layer or component of a softer compressible elastic material for the hard wear layer located in the part of the lifter bar that is primarily exposed to influence by the grinding bodies and/or the grinding material used in the mill, the wearing out of the lifters dependent on the mere wear and on the scrap loss is reduced. At the same time, it is achieved that the wear takes place approximately equally slowly along the entire hight of the lifter bars independently of how high the lifter bar is (of course within certain limits), from the very beginning. In other words, the use of relatively higher lifters in the mills is made possible and, consequently, mills can advantageously be lined with high as well as low lifters, as shown in FIGS. 3 and 5. When the low lifters have become worn out completely, the high ones have been worn down to about half their original height and function thereafter as low lifters. Thus, the completely wornout lifters are replaced by high lifters.

The invention is not restricted to what has been described above and shown in the drawings, but can be modified and supplemented in many different ways within the scope of the invention defined in the claims.

We claim:

1. A wear-resistant lifter element for mounting on a cylindrical wall of a rotary drum of a mill which has a direction of rotation, said element comprising:

a support layer made of resilient elastomeric material, said support layer having a radially outer end, a radially inner end, a leading side, a trailing side, and two longitudinally-opposite ends;

first means for securing said radially outer end of said support layer to a cylindrical wall of a rotary drum of a mill, so that the support layer, while disposed within the rotary drum, projects radially inwardly away from the cylindrical wall of the rotary drum;

at least one wear layer made of metal; and second means securing each said wear layer to said support layer so that said each said wear layer is backed by said leading side of said support layer from said radially inner end radially throughout at least the radially innermost one-third of the height of each said wear layer;

each said wear layer being backed by said support layer throughout substantially all of the length and height of each said wear layer; and said trailing side of said support layer remaining substantially uncovered by each said wear layer, whereby said support layer, in use, remains flexible in a direction circumferentially of the rotary drum of the mill.

2. The wear-resistant lifter element of claim 1, wherein:

said second securing means comprising vulcanization of said support layer to each said wear layer.

3. The wear-resistant lifter element of claim 1, wherein:

said second securing means comprises mechanical fastener means bolting each said wear layer to said support layer.

4. The wear-resistant lifter element of claim 1, wherein:

said at least one wear layer comprises at least two said wear layers arranged spacedly end to end longitudinally along said support layer with elastomeric material of said support layer intervening between adjoining ends of said wear layers.

5. The wear-resistant lifter element of claim 1, wherein:

each said wear layer has a leading face which is disposed substantially perpendicular to said radially outer end of said support layer, so that, in use, the leading face of each said wear layer lies on a longitudinally and radially extending plane of the rotary drum of the mill.

6. The wear-resistant lifter element of claim 1, wherein:

each said wear layer has a leading face which is disposed obliquely to said radially outer end of said support layer, in such a sense that, in use, the leading face of each said wear layer faces somewhat radially inwardly of the rotary drum of the mill.

7. The wear-resistant lifter element of claim 1, wherein:

each said wear layer increases in thickness from said radially inner end of said support layer towards said radially outer end of said support layer.

8. The wear-resistant lifter element of claim 1, wherein:

each said wear layer has a leading face and a trailing face which are substantially parallel to one another.

9. The wear-resistant lifter element of claim 1, wherein:

each said wear layer has a trailing face and said second securing means comprises projection means extending from said trailing face of each said wear layer and fitting in recess means provided in said support layer.

10. The wear-resistant lifter element of claim 1, further including:

lifting lug means provided on each said wear layer.

11. A mill comprising:

a rotary drum having a direction of rotation about a longitudinally-extending axis, said rotary drum including a cylindrical wall having a radially inner surface;

a plurality of circumferentially-spaced wear-resistant lifter elements mounted on said radially inner surface of said cylindrical wall of said rotary drum, each said wear-resistant lifter element comprising:

a support layer made of resilient elastomeric material, said support layer having a radially outer end, a radially inner end, a leading side, a trailing side, and two longitudinally-opposite ends;

first means securing said radially outer end of said support layer to said cylindrical wall of a rotary drum of a mill, so that the support layer is disposed within the rotary drum and projects radially inwardly away from the cylindrical wall of the rotary drum;

at least one wear layer made of metal; and second means securing each said wear layer to said support layer so that said each said wear layer is backed by said leading side of said support layer from said radially inner end radially throughout at least the radially innermost one-third of the height of each said wear layer;

each said wear layer being backed by said support layer throughout substantially all of the length and height of each said wear layer; and said trailing side of said support layer remaining substantially uncovered by each said wear layer, whereby said support layer, in use, remains flexible in a direction circumferentially of the rotary drum of the mill.

12. The mill of claim 11, further including:

means providing a mantle of wear plates secured to said cylindrical wall of said rotary drum circumferentially between circumferentially adjacent ones of said wear-resistant lifter elements;

said wear plates of said mantle means being radially less extensive than said wear-resistant lifter elements;

said wear layer of said wear-resistant lifter elements extending radially outwards to said wear plates of said mantle means.

* * * * *